US007269906B1

(12) United States Patent
Lee

(10) Patent No.: US 7,269,906 B1
(45) Date of Patent: Sep. 18, 2007

(54) MARKING GAUGE

(75) Inventor: Robin C. Lee, Nepean (CA)

(73) Assignee: Lee Valley Tools, Ltd., Ottawa (CA)

( * ) Notice: Subject to any disclaimer, the term of this patent is extended or adjusted under 35 U.S.C. 154(b) by 0 days.

(21) Appl. No.: 11/242,996

(22) Filed: Oct. 4, 2005

Related U.S. Application Data

(60) Provisional application No. 60/615,716, filed on Oct. 4, 2004.

(51) Int. Cl.
*B43L 13/02* (2006.01)

(52) U.S. Cl. ..... 33/42; 33/666

(58) Field of Classification Search ..... 33/42, 33/41.1, 41.3, 41.4, 41.6, 44, 666
See application file for complete search history.

(56) References Cited

U.S. PATENT DOCUMENTS

| | | | | |
|---|---|---|---|---|
| 17,403 | A | 5/1857 | Williams | |
| 36,973 | A | 11/1862 | Traut | |
| 76,884 | A | 4/1868 | Brodhead | |
| 141,475 | A | 8/1873 | Traut | |
| 152,488 | A * | 6/1874 | Hawley | 33/44 |
| 174,879 | A | 3/1876 | Vetterlein | |
| 504,003 | A | 8/1893 | Traut | |
| 602,130 | A * | 4/1898 | Fuller | 33/44 |
| 799,474 | A * | 9/1905 | Larson et al. | 33/44 |
| 869,649 | A | 10/1907 | Pringle | |
| 5,050,306 | A * | 9/1991 | Renaud | 33/41.1 |
| 5,197,195 | A * | 3/1993 | Aikens | 33/42 |

OTHER PUBLICATIONS

Frampton, Alice, "Wheel Marking Guages Review," Woodworking Magazine, WoodCentral, (2005); http://www.woodcentral.com/cgi-bin/readarticle.pl?dir=reviews&file=articles_734.shtml, printed Nov. 29, 2006.

* cited by examiner

*Primary Examiner*—Christopher W Fulton
(74) *Attorney, Agent, or Firm*—Kilpatrick Stockton LLP; John S. Pratt; Camilla C. Williams

(57) ABSTRACT

A marking gauge for marking a line parallel to an edge of a surface having a shaft, a fence for contact with the edge, and marker connections that allow markers of different types to be utilized in the alternative to mark the line. Other marking gauge features include a swivel chuck, a depth-adjustable chuck, and a fence positioned eccentric on the shaft of the marking gauge.

15 Claims, 7 Drawing Sheets

MARKING GAUGE

RELATED APPLICATION DATA

This application claims priority to U.S. Provisional Patent Application No. 60/615,716, filed Oct. 4, 2004 and entitled "Marking Gauge," which is incorporated by this reference.

FIELD OF THE INVENTION

This invention relates generally to woodworking tools and more specifically to marking gauges that are useful in various woodworking tasks.

BACKGROUND

A marking gauge is used to mark a line on a surface, where the line is parallel to the edge of the surface. In the case of woodworking, such marks are often made prior to sawing, chiseling or cutting the wood surface. Generally, marking gauges include a fence secured around a shaft. The fence is pressed against the edge of the surface as a sharp marker projecting down from one end of the shaft marks the line. Thus, the fence pressed against the surface edge keeps the marker a constant distance from that edge, allowing a parallel line to be marked. The shaft is typically labeled to show distance (i.e. 16ths of an inch) so that the distance of the line from the surface edge may be adjusted by adjusting the position of the fence along the marking gauge shaft.

Historically, marking gauges have employed a pin or knife-edge as a marker. Generally, pin markers are thought to have advantages when used to make marks along wood grain, and knife-edge cutters, including wheel and blade cutters, are thought to have advantages when used to make marks across wood grain. Wheel cutters are thought to offer advantages when marking shallow marks across the grain because they tend to leave clean mark lines without tearing fibers. Blade cutters are thought capable of cutting deeper in cases where a more pronounced cut or mark is required. Traditionally, blade cutters are fixed directly on the shaft of a marking gauge with a set screw, with the long edge of the blade parallel to the marker's fence. As a result, blade cutters tend to follow the wood grain, in many cases pushing the fence away from the workpiece.

A standard marking gauge is typically limited to a single type of marking method (i.e. pin marking, wheel cutter, or blade cutter). A number of tools perform one or two tasks such as trammels, marking and scribing gauges, but no single marking gauge is capable of performing all three operations with one tool.

SUMMARY OF THE INVENTION

This invention provides a marking gauge for marking a line parallel to an edge of a surface. The marking gauge has a shaft, a fence, and utilizes in the alternative one of three markers: a wheel cutter; a blade cutter; and a pin. The marking gauge has one or more marker connections that allow markers of different types to be utilized in the alternative to mark the desired line. The fence is attached to the marking gauge shaft and pressed against a workpiece edge so that the utilized marker is held a predetermined distance from the edge, making a mark parallel to the edge. A user may adjust the position of the fence along the shaft to adjust the distance of the parallel mark from the edge and may select the marker type to use for a particular task. For example, a pin marker may be selected to mark along wood grain, a blade cutter may be selected to deeply mark across wood grain, and a wheel cutter may be selected to make a clean, shallow mark across wood grain.

The selected marker may be secured to the marking gauge in a variety of ways. Preferably, the wheel cutter is secured to one the end of the shaft using a screw and the blade cutter and pin markers are removably and interchangeably secured near the other end of the shaft, using a chuck with a set screw. Other configurations are possible.

This invention also provides a chuck having several advantageous features. A swivel chuck feature allows the user to rotate or skew the edge of a cutting blade slightly away from the fence (e.g. 5 degrees). In use, the slightly skewed cutting blade causes the gauge to pull the fence against the workpiece as the cutting blade is moved along the workpiece. This provides particular advantages in deep grained wood workpieces by forcing the blade to follow the desired path rather than the grain of the wood. This invention also provides a depth-adjustable chuck feature that allows the cutting blade or pin to be adjusted to various depth projections. Both the position of the chuck in the shaft and the depth of the cutting blade or pin in the chuck can be adjusted providing a wide range of projection depths.

This invention also provides an offset fence feature that allows the fence to be positioned eccentric on the shaft of the marking gauge (i.e., the shaft hole through the fence is off-center). This maximizes the surface area of the fence in contact with the workpiece and limits any rolling of the marking gauge that may occur when it is laid on its side.

DETAILED DESCRIPTION

Figure 1:
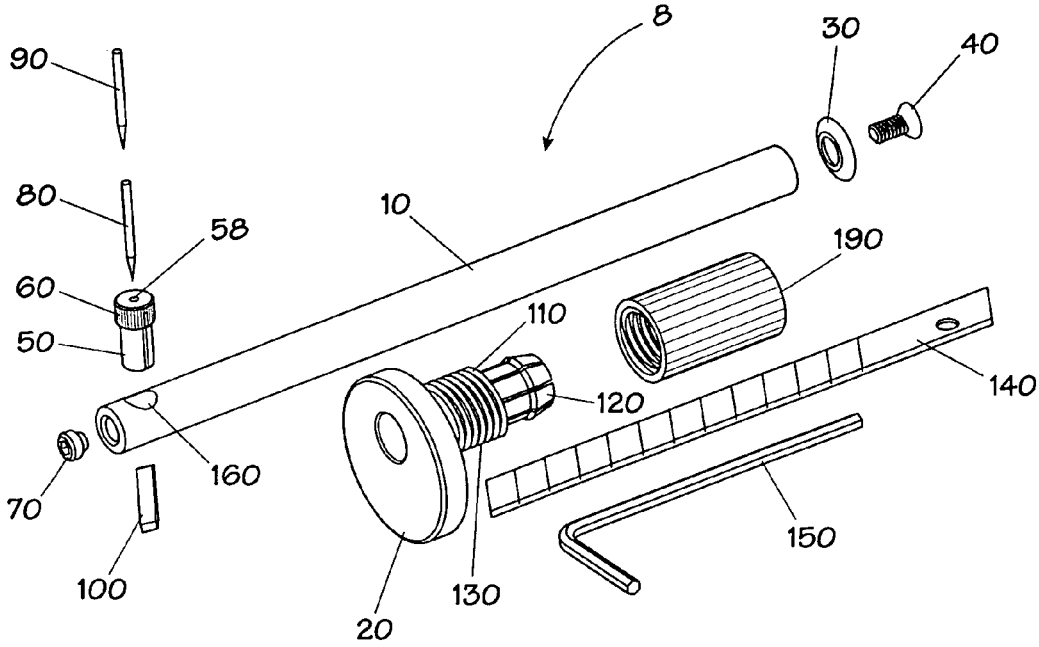
FIG. 1 is an exploded perspective view of a marking gauge and associated tools.

The marking gauge 8 shown in the Figures has a shaft 10, a fence 20 for contact with a workpiece edge, and marker connections that allow markers of different types to be utilized in the alternative to form the line being made with the gauge 8. A screw 40 attaches a wheel cutter 30, and a chuck 50 attaches a blade cutter 100, pin 80 or pencil lead 90. The screw 40 for the wheel cutter 30 and chuck 50 for the blade cutter 100, pin 80 or pencil lead 90 are located near opposite ends of the shaft 10. The fence 20 direction may be reversed so that it may be used with markers located near either end of the shaft 10.

FIGS. 1-4 illustrate the components of the marking gauge of this invention. The shaft 10 is generally a long cylindrical body or rod to which a fence 20 and a variety of markers may be attached. The position of the fence 20 may be adjusted to virtually any desired distance from a marker located near either end of the shaft 10. This allows a user to adjust the distance of the line to be formed from the edge of the surface to be marked.

The fence 20 may be approximately one inch in diameter and positioned eccentric on the shaft 10 (i.e., the hole through the fence is off-center) to maximize the surface area of the fence in contact with the workpiece and limit rolling of the marking gauge that may occur when it is laid on a work bench.

Figure 2:
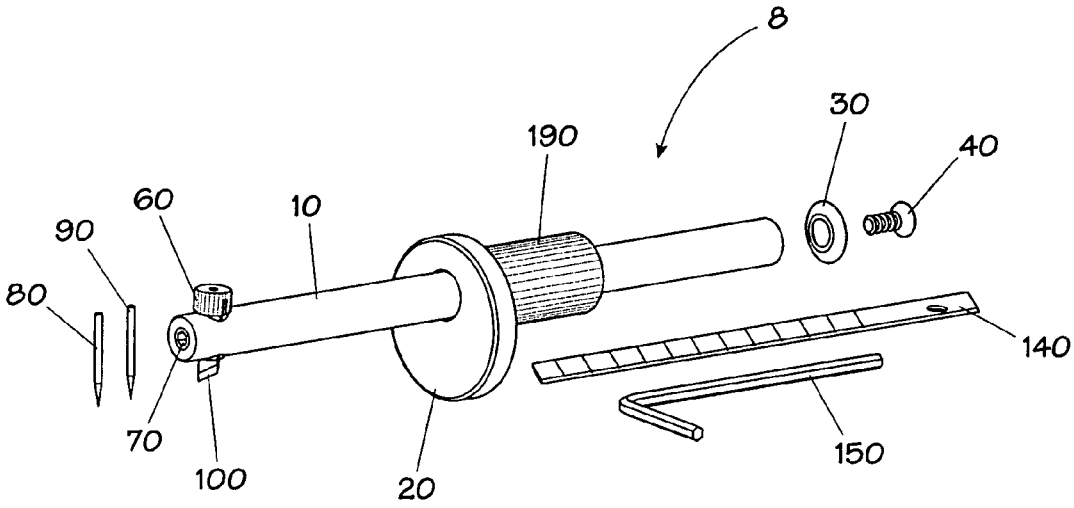
FIG. 2 is another perspective view of the marking gauge of FIG. 1 with the fence attached to the shaft.
Figure 3:
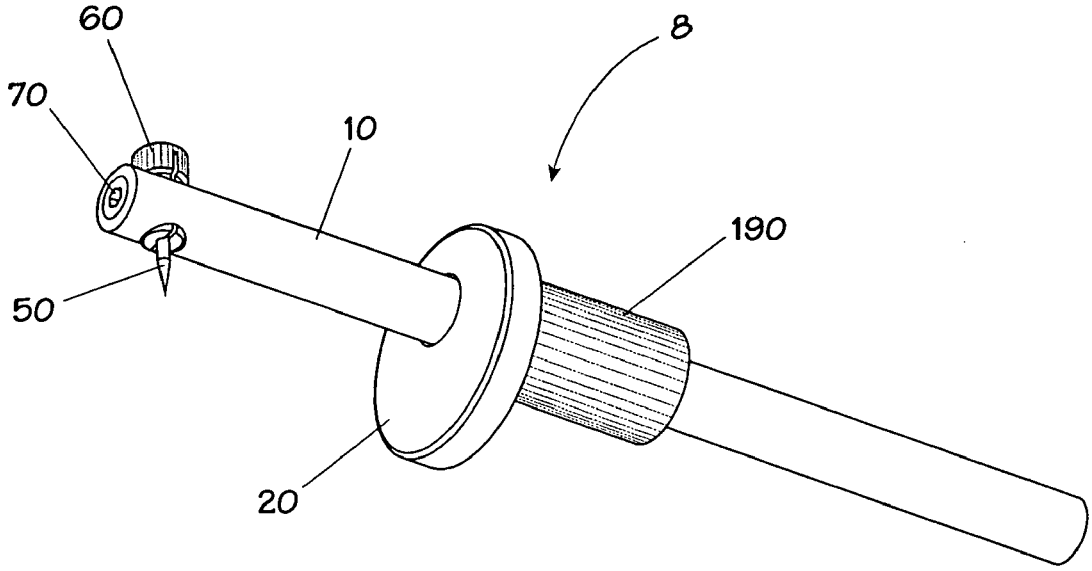
FIG. 3 is a perspective view of the marking gauge shown in FIG. 1 with a pin attached.
Figure 4:
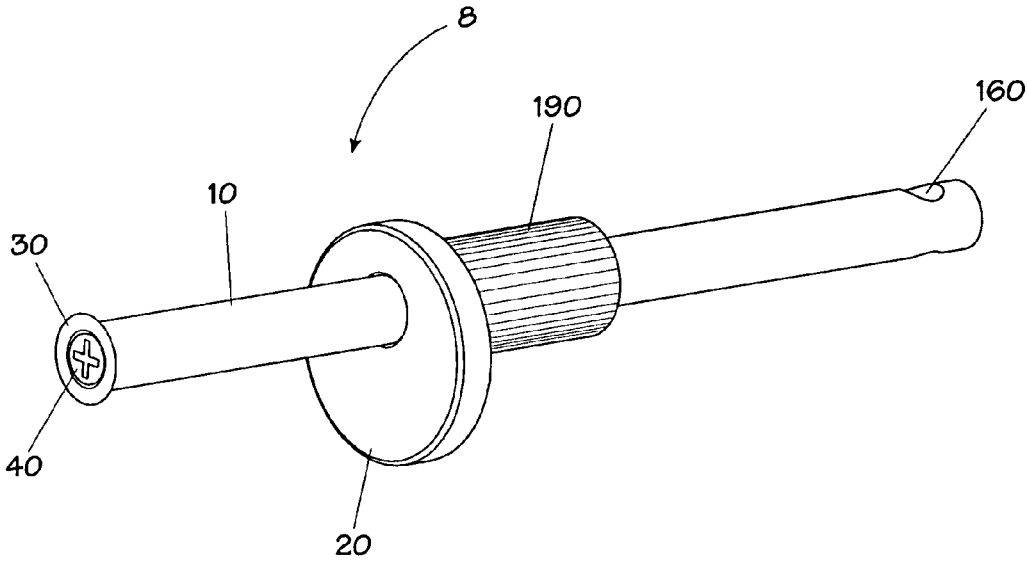
FIG. 4 is a perspective view of the marking gauge shown in FIG. 1 with wheel cutter attached.

Components for a first marker type, a wheel cutter 30, are illustrated in FIGS. 1, 2, and 4. The wheel cutter 30 is secured to one end of the shaft 10 with a screw 40, which may be tightened by hand or with a tool 150. While not in use, the wheel 30 and screw 40 may be removed. Wheel 30 is preferably beveled on its inside face. In use this bevel tends continuously to force the cutter to drift away from the work piece edge being contacted by the fence, thereby urging the fence to remain in contact with the work piece edge. As the cutter is moved along the surface, the beveled edge of the wheel cutter holds the fence against the edge.

Components for additional marker types, a blade cutter 100, a pin cutter 80, and a pencil lead 90, are shown in FIGS. 1-3 and 5-6. The marking gauge has a swivel chuck 50 used to attach a blade cutter 100, pin 80, pencil lead 90 or marker of another type. The swivel chuck 50 allows a marker edge (i.e. the edge of a cutting blade 100) to be rotated. The swivel chuck 50 is positioned within a hole 160 in the shaft 10 with a knob 60 protruding from the top of the shaft 10. The swivel chuck knob 60 allows a user to adjust the rotation of the swivel chuck 50 within the shaft 10. The swivel chuck 50 is held in the opening 55 of the chuck 50 by a set screw 70.

The use of a swivel chuck 50 allows a method of marking a line parallel to an edge of a surface that involves first positioning a marking gauge comprising a shaft 10, a fence 20, and a swivel chuck 50 such that the fence 20 presses up against the edge and the blade cutter 100 rests on the surface, with the swivel chuck 50 rotated about 5 degrees offset from parallel to the fence 20. The line on the surface is then marked by moving the marking gauge along the surface such that the fence 20 remains pressed against the edge and the marker remains pressed against the surface. The 5 degree offset (wider in the advancing direction) helps keep the fence 20 pressed against the edge during marking.

Figure 5:
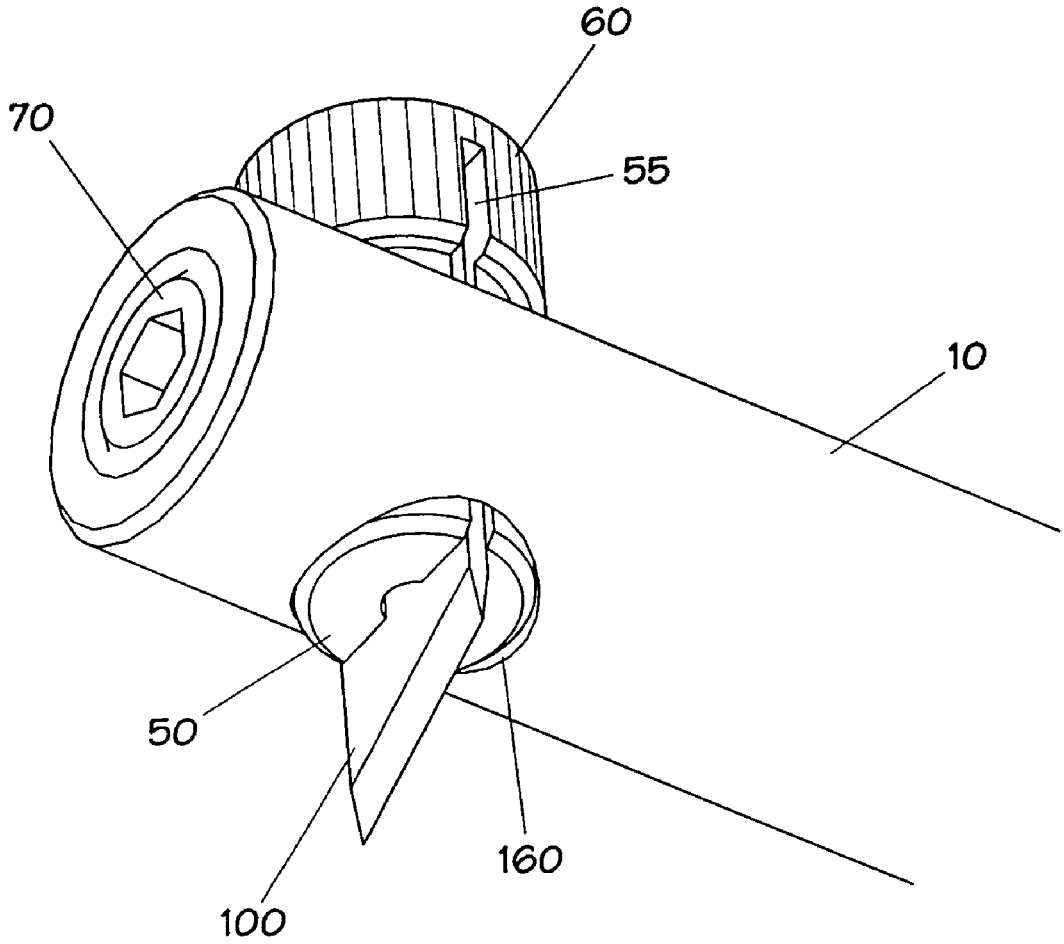
FIG. 5 is an enlarged perspective view of the tip of the marking gauge shown in FIG. 1 with a blade cutter attached.
Figure 6:
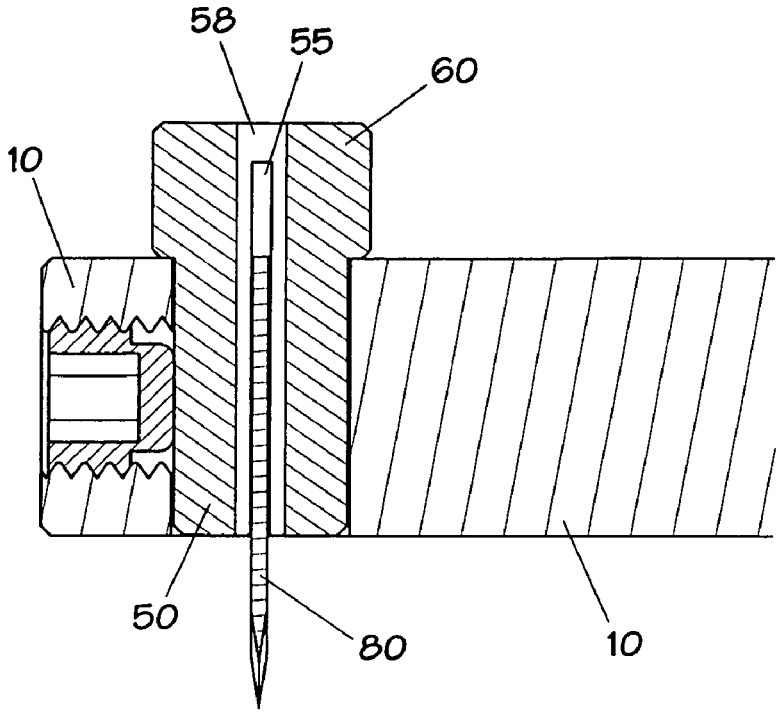
FIG. 6 is a side view of the tip of a marking gauge with pin attached in section along the axes of the shaft and pin.

FIG. 5 illustrates the tip of a marking gauge with a blade cutter 100 attached using a swivel chuck 50. A blade cutter 100 may be broken off from a sheet of blade cutters 140. The chuck 50 is positioned in a perpendicular through-hole 160 in the shaft 10. The chuck 50 allows a user to rotate/skew the long edge of the cutting blade 100 away from the fence 20, which in turn in use tends continuously to force the cutter to drift away from the work piece edge being contacted by the fence 20 even in deep grained woods, thereby urging the fence 20 to remain in contact with the work piece edge. The chuck 50 can be fully rotated to accommodate a left or right handed user. The cutting blade 100 is received in an opening or slot 55 in the chuck 50.

The depth of the chuck 50 in the hole 160 may be adjustable using the same set screw 70 used to secure the marker 80, pencil lead 90, or 100, within the opening 55 of the chuck 50. This allows the depth of the projection of the marker to be adjustable by changing the depth of the chuck 50 in the hole 160 and/or the depth of the marker 80, pencil lead 90, or 100 in opening 55 of the chuck 50. The chuck 50 is received in a through-hole 160 on the gauge shaft 10 and can be securely locked at varying positions/depths through the shaft 10 by tightening a set screw 70 located axially near the end of the shaft 10. For example, the set screw 70, when tightened, may secure a cutting blade 100 within a slot 55 in the chuck and press the chuck body against the wall of the hole 160. The combination of blade position in the slot and the adjustable depth of the chuck 50 on the shaft 10 accommodates projection ranges from near zero to ¼ inch or more.

The chuck 50 can also be used to secure a pin cutter 80 or pencil lead 90, which may have similar shapes so that either may be secured with the same structures. A small through hole 58 located in the center of the chuck 50 can receive a straight pin 80, pencil lead 90 for scratch marking. The hole 58 may pass through or intersect the slot 55 in the chuck 50 and may have a diameter that is slightly larger than the width of the slot 55. The interior shape of the chuck, with opening 55 and hole 58, allows the chuck 50 to secure a blade cutter 100 or a pin 80 or pencil lead 90. The chuck can have both an opening 55 that has a shape similar to the cross section of a blade cutter 100 so that a blade cutter 100 can be secured when the chuck 50 is tightened and a hole 58 with a shape similar to the cross section of the pin 80 so that when the chuck 50 is tighted the pin is secured.

The pin 80 or pencil lead 90 depth can be adjusted from zero to 0.5" or more and can be locked into position with the set screw 70. As with the blade cutter 100, the depth of the pin 80, pencil lead 90 may be adjusted by adjusting both the depth of the chuck 50 in the shaft 10 and the depth of the pin 80, pencil lead 90 in the chuck 50.

The marking gauge of the present invention is preferably made of brass, but may be made of any suitable material or combination of materials.

Figure 7:
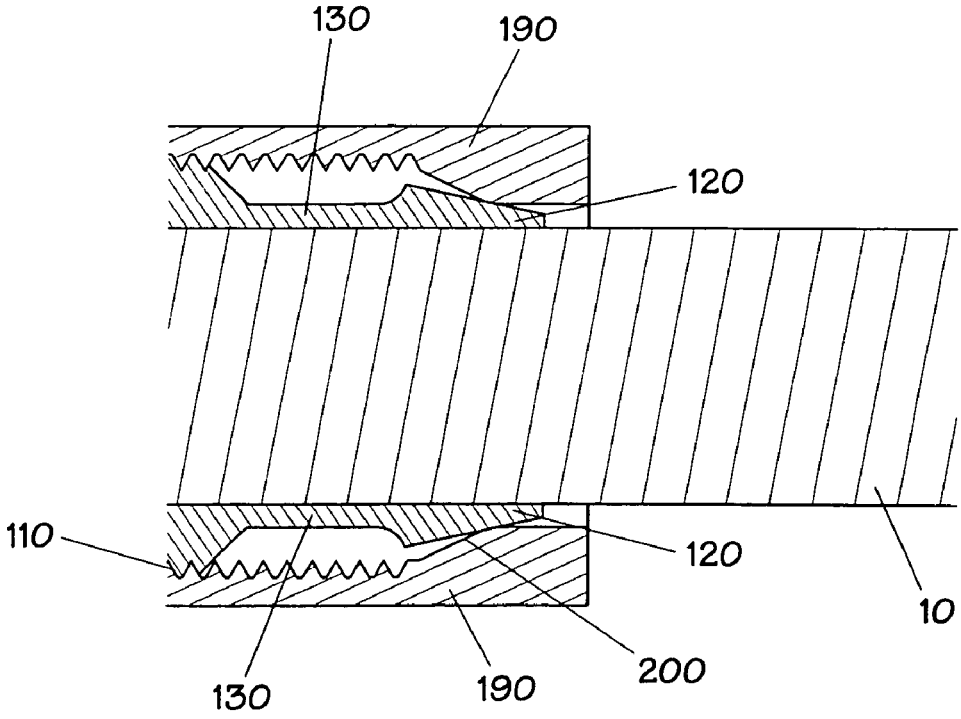
FIG. 7 is an enlarged fragmentary view, in section, of a portion of the collet, locking sleeve, and shaft of the marking gauge of FIG. 1.

FIGS. 1 and 7 illustrate an adjustable fence attachment that allows the location and direction of the fence 20 to be adjusted. The position of the fence 20 may be adjusted to virtually any desired distance from a marking option located near either end of the marking gauge shaft 10. This allows a user to adjust the distance of the line to be drawn from the edge of the surface to be marked. This adjustment may be made by turning a knurled locking-sleeve 190 so that the locking sleeve 190 tightens onto threads 110 of the collet 130. As the locking sleeve 190 is tightened, angled fingers 120 on collet 130 are pressed inwardly by angled portions 200 of the locking sleeve 190 such that they are pressed firmly against the outside of shaft 10, securing the position of the fence 20 and collet 130 along the shaft 10. Thus, the position of the fence can be adjusted by loosening the locking sleeve 190 and sliding the fence 20 and collet 130 along the shaft 10. Once the fence is in its desired location, the collet 130 may be tightened to lock the fence 20 into place. The direction of the fence 20 may be reversed by sliding the fence 20 off the end of the shaft 10, reversing its direction, and reinstalling it along the shaft 10. Preferably, the fence 20 and collet 130 are made from a single eccentric brass turning.

Figure 8:
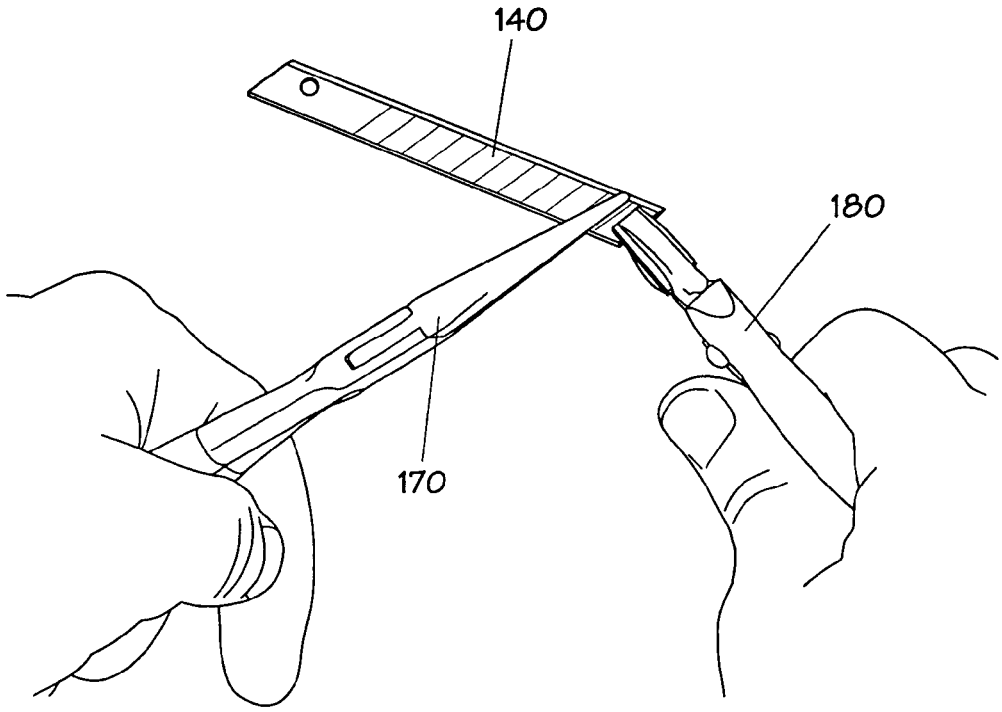
FIG. 8 is a perspective view of a blade cutter being removed from a sheet of blade cutters.

FIG. 8 is a perspective view of a blade cutter being removed from a sheet of blade cutters 140 using handheld gripping tools 170, 180. The sheet of blade cutters 140 provides a convenient and safe means of storing multiple blade cutters prior to use.

The marking gauge components and methods of this invention are not confined to the embodiments described herein but includes variations and modifications within the scope and spirit of the foregoing description, the accompanying drawings and the following claims. For example, the components of the marking gauge may be made of any suitable material or combination of materials, e.g. metal, wood, plastic, or rubber. As another example, the fence and shaft may have any suitable shapes, e.g. circular, square, rectangular, and triangular. The fence or shaft may have holes, hollow portions, windows, markings, indicia of measurement, indicia of alignment, indicia of levelness, and other features and properties. Suitable variations and alternatives to the marking devices described herein are also possible. For example, a marker may scratch or write a line of a variety of widths.

The invention claimed is:

1. A marking gauge for marking a line parallel to an edge of a surface, comprising:

(a) a shaft having two ends;

(b) a fence mounted on the shaft for contact with the edge; and (c) a plurality of marker connections wherein one or more of the plurality of marker connections is on or proximate each of the shaft ends, wherein the marker connections allow one of at least three markers of different types to be utilized in the alternative to mark the line and wherein the at least three markers of different types comprise a wheel cutter; a blade cutter; and a pin;

wherein a marker connection of the plurality of marker connections is a chuck mounted proximate one end of the shaft, wherein the chuck comprises a chuck body defining an opening for securing a blade cutter and a hole for securing a pin, wherein the opening has a shape similar to the cross section of the blade cutter and the hole has a shape similar to the cross section of the pin, wherein the hole and opening have a common center.

2. The marking gauge of claim 1, wherein the hole has a diameter that is greater than a width of the opening.

3. The marking gauge of claim 1, wherein the plurality of marker connections further comprises a set screw for attaching a wheel cutter proximate an end of the shaft different from the end proximate to the chuck.

4. The marking gauge of claim 3, wherein the set screw and chuck are located near or in opposite ends of the shaft.

5. The marking gauge of claim 1, wherein the fence is movable along the shaft such that the distance of the line to be drawn from the edge may be adjusted.

6. The marking gauge of claim 1, wherein the fence has a generally round, flat surface penetrated by a hole for the shaft, wherein the hole is not centered on the surface so that there are differing amounts of surface on two opposing sides of the shaft.

7. A marking gauge for marking a line parallel to an edge of a surface, comprising:

(a) a shaft having two ends;

(b) a fence mounted on the shaft for contact with the edge; and (c) a plurality of marker connections wherein one or more of the plurality of marker connections is on or proximate each of the shaft ends, wherein the marker connections allow one of at least three markers of different types to be utilized in the alternative to mark the line and wherein the at least three markers of different types comprise a wheel cutter; a blade cutter; and a pin;

wherein a marker connection of the plurality of marker connections is a chuck mounted proximate one end of the shaft, wherein the chuck is generally cylindrical and is received in and can swivel in a hole near one end of the shaft, permitting an edge of a cutting blade to be rotated.

8. A marking gauge for marking a line parallel to an edge of a surface, comprising:

(a) a shaft having two ends;

(b) a fence mounted on the shaft for contact with the edge; and (c) a plurality of marker connections wherein one or more of the plurality of marker connections is on or proximate each of the shaft ends, wherein the marker connections allow one of at least three markers of different types to be utilized in the alternative to mark the line and wherein the at least three markers of different types comprise a wheel cutter; a blade cutter; and a pin;

wherein a marker connection of the plurality of marker connections is a chuck mounted proximate one end of the shaft, wherein the chuck comprises a chuck body defining an opening for securing a blade cutter and a hole for securing a pin, wherein the opening has a shape similar to the cross section of the blade cutter and the hole has a shape similar to the cross section of the pin, wherein the chuck is positioned within a hole in the shaft and held in place by a set screw that is threaded into a second hole in the shaft communicating with the first hole so that an end of the set screw can contact the chuck.

9. The marking gauge of claim 8, wherein a depth of the chuck in the hole is adjustable using the set screw.

10. A marking gauge for marking a line parallel to an edge of a surface, comprising:

(a) a shaft having two ends;

(b) a fence mounted on the shaft for contact with the edge; and (c) a plurality of marker connections wherein one or more of the plurality of marker connections is on or proximate each of the shaft ends, wherein the marker connections allow one of at least three markers of different types to be utilized in the alternative to mark the line;

wherein a marker connection of the plurality of marker connections is a chuck mounted proximate one end of the shaft, wherein the chuck comprises: (i) a chuck body having an opening for securing a blade cutter, wherein the opening has a shape similar to the cross section of the blade cutter; and (ii) a hole formed by the chuck body for securing a pin, wherein the hole has a shape similar to the cross section of the pin;

wherein the chuck is positioned within a hole in the shaft and held in place by a set screw that is threaded into a second hole in the shaft communicating with the first hole so that an end of the set screw can contact the chuck; and wherein a depth of projection of a marker is adjustable using a set screw that secures a depth of the chuck in the hole and a depth of the marker in the chuck.

11. A marking gauge for marking a line parallel to an edge of a surface, comprising:

(a) a shaft having two ends;

(b) a fence for contact with the edge; and (c) a swivel chuck for attaching a blade cutter proximate one end of the shaft, wherein the swivel chuck is rotatable to thereby rotate an edge of the blade cutter.

12. The marking gauge of claim 11, wherein the swivel chuck is positioned within a hole in the shaft and held in place by a set screw threaded into a second hole in the shaft and rotatable to press against the chuck.

13. A method of marking a line parallel to an edge of a surface, comprising:

(a) positioning a marking gauge comprising a fence mounted on a shaft and a swivel chuck attaching a marker to the shaft such that the fence presses against the edge and the marker rests on the surface, wherein the swivel chuck is rotated about 5 degrees offset from parallel to the fence; and (b) marking the line on the surface by moving the marking gauge along the surface such that the fence remains pressed against the edge and the marker remains pressed against the surface.

14. A marking gauge for marking a line parallel to an edge of a surface, comprising:

(a) a shaft having two ends;

(b) a fence mounted on the shaft for contact with the edge; and (c) a depth-adjustable chuck for attaching a marker, wherein the depth adjustable chuck is positioned within a hole in the shaft and held in place by a set screw and wherein a depth of projection of the marker is adjustable using a set screw that secures a depth of the chuck in the hole and a depth of the marker in the chuck.

15. The marking gauge of claim 14, wherein the fence has a generally round, flat surface penetrated by a hole for the shaft, wherein the hole is not centered on the surface so that there are differing amounts of surface on two opposing sides of the shaft.

* * * * *